US009707776B2

(12) United States Patent
Gady et al.

(10) Patent No.: US 9,707,776 B2
(45) Date of Patent: Jul. 18, 2017

(54) METHOD OF AND APPARATUS FOR PRINTING ON A WEB

(71) Applicant: SICPA HOLDING SA, Prilly (CH)

(72) Inventors: Sylvain Gady, Prilly (CH); Sebastien Mazerolle, Mauborget (CH); Nicolas Uebelhart, Gland (CH)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 15/039,595

(22) PCT Filed: Nov. 25, 2014

(86) PCT No.: PCT/EP2014/075509
§ 371 (c)(1),
(2) Date: May 26, 2016

(87) PCT Pub. No.: WO2015/078851
PCT Pub. Date: Jun. 4, 2015

(65) Prior Publication Data

US 2017/0066253 A1 Mar. 9, 2017

(30) Foreign Application Priority Data

Nov. 27, 2013 (EP) ..... 13194667

(51) Int. Cl.
*B41J 2/15* (2006.01)
*B41J 11/00* (2006.01)
*B41M 5/00* (2006.01)

(52) U.S. Cl.
CPC ..... *B41J 11/002* (2013.01); *B41M 5/0011* (2013.01)

(58) Field of Classification Search
CPC ..... B41J 13/0009; B41J 11/46; B41J 11/007; B41J 11/42; B41J 2/01; B41J 11/0005; B41J 11/003; B41J 11/0045; B41J 11/04; B41J 13/02; B41J 13/03; B41J 11/002; B41J 11/0015; B41J 29/38; B41J 11/004; B41J 13/103; B41J 2/04515; B41J 2/07
See application file for complete search history.

(56) References Cited

U.S. PATENT DOCUMENTS 6,398,358 B1 6/2002 Miyake et al.
9,440,459 B1 * 9/2016 Fromm ..... B41J 11/002
9,457,603 B2 * 10/2016 Aerts ..... B41J 3/60
9,463,649 B1 * 10/2016 Liu ..... B41J 3/543

FOREIGN PATENT DOCUMENTS

WO 2011/051396 5/2011

* cited by examiner

*Primary Examiner* — Lamson Nguyen
(74) *Attorney, Agent, or Firm* — Greenblum & Bernstein, P.L.C.

(57) ABSTRACT

Method and means of printing on a web. The method means comprise in a normal mode: feeding the web in a machine direction; printing on the web with a printer; and drying or curing the printing with a dryer or curer located downstream, with respect to the machine direction, of the printer; and in a pause mode: pausing printing on the web; feeding the web in the machine direction while printing on the web is paused by a distance such that a portion of the web located between the printer and the dryer or curer, the portion having printing thereon that has not yet been cured or dried, is fed through the dryer or curer to dry or cure the printing; and thereafter pausing feeding of the web in the machine direction.

25 Claims, 7 Drawing Sheets

METHOD OF AND APPARATUS FOR PRINTING ON A WEB

CROSS-REFERENCE TO RELATED APPLICATIONS

The present application is a U.S. National Stage of International Application No. PCT/EP2014/075509 filed Nov. 25, 2014, which claims priority of European Patent Application No. EP 13 194 667.5 filed Nov. 27, 2013. The disclosure of International Application No. PCT/EP2014/075509 is expressly incorporated by reference herein in its entirety.

FIELD OF THE INVENTION

The present invention relates to printing on a web of material being fed in a machine direction, wherein the printing is required to be dried or cured. The present invention particularly relates to improved implementation of a pause mode for the printing on the web and feeding of the web.

BACKGROUND TO THE INVENTION

It is known in the art to print data on a web of material and to cure or dry the printed data with a dryer or curer. The webs of material may comprise paper, such as blank paper or pre-printed paper, and may be a web for making adhesive labels, e.g. with a paper based substrate having an adhesive and a side for printing on. One application of such printing art relates to printing codes on product labels, stamps or packaging. The codes may be 1D or 2D bar codes and/or alphanumeric codes. Such codes can be useful in tracing the associated product through a supply and distribution chain, and may also be useful in accounting for tax duty on certain kinds of products such as alcoholic beverages, tobacco products and pharmaceutical products. Additional or alternative printing may be performed on the web of material including patterns and/or security markings. One known type of process is a reel to reel process in which blank web is fed from a source reel to a printer for printing data on the web and subsequently to a dryer or curer for drying or curing the printed data. The printed web is wound about a target reel. It may be necessary to pause feeding the web and printing on the web, which can cause the printed data to suffer in quality and/or web wastage, for reasons explained more fully below with reference to FIGS. 3 to 5.

The present invention has been conceived in the light of such background art, although the technical solutions offered by the present invention are more widely applicable.

SUMMARY OF THE INVENTION

In a first aspect of the present invention, there is provided a method of printing on a web, the method comprising:

in a normal mode:

feeding the web in a machine direction;

printing on the web with a printer; and drying or curing the printing with a dryer or curer located downstream, with respect to the machine direction, of the printer;

and in a pause mode:

pausing printing of the web with the printer;

feeding the web in the machine direction a distance such that a portion of web located between the printer and the dryer or curer, which has printing thereon that has not yet been cured or dried, is fed through the still active dryer or curer to dry or cure the printing; and thereafter pausing feeding of the web in the machine direction.

According to the first aspect, the pause mode does not simultaneously pause both the printing and web feeding steps as this would result in printing on the web located between printer and the dryer or curer that is not properly dried or cured. Improper drying or curing can result in lowering of the print quality. In the first aspect of the present invention, the feeding step continues from the normal mode in the pause mode for a sufficient time/distance to bring the printed but not yet dried or cured printing through the printer or dryer. It is only after complete drying of all printing carried out before entering the pause mode that the feeding of the web is also paused. In this way, print quality is maintained even when the printing process incurs a pause mode.

The pause mode may be required for machine maintenance, such as maintenance of the printer, the dryer or curer and/or the below mentioned quality controller or other units making up the machine and described below.

In the method of the first aspect, a transition takes place from the normal mode to the pause mode. At the start of the pause mode, there is a stretch of web extending between the printer and the dryer or curer that has printing thereon from the printing step during the normal mode that has not yet been dried or cured. The web continues to be fed during the pause mode by a distance at least sufficient or just sufficient to pass the stretch of web through the dryer or curer so that the printing on the stretch of web is dried or cured thereby.

In a second aspect, an apparatus for printing on a web is provided, the apparatus comprising:

feeder for feeding the web in a machine direction;

a printer for printing on the web;

a dryer or curer located downstream, with respect to the machine direction, of the printer, the dryer of curer for drying or curing the printing on the web; and controller configured to implement a normal mode of operation in which the web is fed in the machine direction, the web is printed on with the printer, and the printing is dried or cured with the dryer or curer;

the a controller being further configured to implement a pause mode in which printing of the web by the printer is paused, feeding of the web in the machine direction by the feeder is continued while the printing is paused such that the printed but not yet cured or dried printing on the web located between the printer and the dryer or curer is fed through the dryer or curer to dry or cure the printing, and thereafter pausing the feeding of the web in the machine direction.

In the first and second aspects, the printing is paused throughout the paused mode, while feeding of the web in the machine direction is also paused throughout the paused mode following an initial delay when the web is fed to finish curing or drying the printing located in the portion between the printer and the dryer or curer.

In an embodiment of the first aspect, feeding the web in the machine direction is carried out at the same speed in the pause mode and in the normal mode. In an alternative embodiment, feeding the web in the machine direction is carried out at a lower speed in the pause mode than in the normal mode. In an embodiment of the second aspect, the controller is configured to feed the web in the machine direction at the same speed or a lower speed (as compared to the speed in the normal mode) in the pause mode. This lower speed may be implemented by gradually reducing the web speed from its speed during the normal mode to a stop condition after the printed but not yet cured portion of the web has been passed through the dryer or curer. The gradual speed reduction can be carried out by a continuous speed reduction or by plural/multiple stepwise speed reduction. Such an embodiment assists in avoiding abrupt speed changes during the pause mode, which is not good for machine operation and avoids a jittering operation. In this way, the remaining printing that has not yet been dried or cured is dried or cured in substantially the same manner in the pause mode as in the normal mode to ensure print quality. When operated at a lower machine directional speed in the pause mode, the web can be brought to a zero speed with reduced machine vibration.

In an embodiment of the first aspect, in the normal mode, the printing with the printer takes place continuously on the web at regular spacing along the web. In an embodiment of the second aspect, the controller is configured to implement the normal mode so that the printing with the printer takes place continuously on the web at regular spacing.

In an embodiment, the web is to be portioned into regular sized portions and each portion has printing printed thereon in the normal mode. Alternatively, the web is to portioned into predetermined portions, whether regularly sized or irregularly sized, and the controller is configured to control the printer in the normal mode of operation to print on each of the predetermined portions. The portions represent continuously repeating locations in the web to which discrete printing items are to be printed. The portions may represent labels, stamps or product packaging for respective products. In an embodiment, the printing comprises discrete data items, such as codes, with one or more data items printed on each portion.

In an embodiment, the pause mode is entered after running the normal mode.

In an embodiment of the first aspect, the method comprises a resume mode for exiting the pause mode and re-entering the normal mode. In the resume mode, the method comprises moving the web counter to the machine direction so that an unprinted portion (which results from the feeding step in the pause mode while the printer is paused) of the web located between the printer and the dryer or curer is positioned upstream, relative to the machine direction, of the printer, the method comprising re-entering the normal mode so that the unprinted portion of the web is printed on with the printer and dried or cured by the dryer or curer as the web is fed in the machine direction.

The pause mode of the method leads to an unprinted portion of the web extending between printer and the dryer or curer because the web is fed in the machine direction while the printer is paused. This unprinted portion of the web is not desirable as it detracts from the continuous printing and wastes web. The above described embodiment moves the web back so that the unprinted portion is located upstream of the printer, thereby allowing the printing to continue at the location it finished upon changing from the previous normal mode to the pause mode and thus reducing web wastage.

In an embodiment of the second aspect, the controller is configured to implement a resume mode of operation after exiting the pause mode and before re-entering the normal mode. That is, the resume mode bridges the pause mode and the normal mode. The controller is configured to implement the resume mode in which the web is moved counter to the machine direction to move an unprinted portion of the web located between the printer and the dryer or curer, the unprinted portion being a result of the pause mode in which the web has been fed in the machine direction with the printer paused, counter to the machine direction to position the unprinted portion upstream, relative to the machine direction, of the printer, the controller configured to subsequently re-enter the normal mode of operation in which the printer prints on the unprinted portion of the web and the dryer or curer dries the printing as the web is fed in the machine direction.

In an embodiment of the first aspect, the method comprises, in the normal mode, printing on the web at each of equally sized/regularly spaced/predetermined portions of the web, the portions repeating continuously along the web, wherein in transitioning between the pause mode and the normal mode, the resume mode moves the web counter to the machine direction such that the first printed web portion upon re-entry into the normal mode is adjacent the last printed web portion when the previous normal mode was exited. This enables printing on each web portion in changing from the normal mode, to the pause and resume modes, and back to the normal mode.

The required extent of movement of the web counter to the machine direction during the resume mode may be determined via the use of position sensors for detecting portions of the web providing position information. Alternatively, sensors may be provided suitable for distinguishing between printed and unprinted portions of the web. The web is counter fed in accordance with the sensor detecting the transition from a printed portion to an unprinted portion. As a further alternative, a measuring wheel may be employed that rotates as the web is fed by an amount proportional to the web feed distance, such as an encoder wheel in contact with the web. The web is counter fed until the sufficient distance is registered by the measuring wheel.

According to the above embodiment, it is possible to ensure that the printing is performed continuously at the designated equally sized web portions, despite the pause mode having been entered. This is because the web is moved backward in the resume mode to a position locating the unprinted portion of the web upstream of the printer and the normal mode is commenced in time to allow the printer to continue printing on the web portions without any web portions being missed and without printing on the same web portion twice.

In an embodiment of the second aspect, the control system is configured to implement the normal mode of operation by printing with the printer at each of equally sized/regularly spaced/predetermined web portions repeating continuously along the machine direction of the web, the control system configured to re-enter the normal mode after the pause mode by controlling the printer to commence printing on the first web portion located upstream of the web portion last printed on during implementing the previous normal mode, to continue the sequence of printing on each equally sized/regularly spaced/predetermined web portion.

In an embodiment of the first aspect, the method comprises detecting portions of the web with a position sensor located upstream of the printer and triggering printing on the web in the normal running mode based on the detected portions. In an embodiment, the detected portions of the web are equally/regularly spaced along the machine direction of the web and the printing with the printer in the normal mode is on each of the portions.

In an embodiment of the second aspect, the apparatus comprises a position sensor located upstream of the printer for detecting portions of the web that are regularly spaced/equally sized in the machine direction throughout the web, and the control system is configured to implement the normal mode by triggering the printer to print on each portion of the web based on the detection of the portions by the position sensor.

The position sensor of the above embodiments ensures accuracy of placement of the printing on the web.

In an embodiment of the first aspect, the printing is in the form of readable data (e.g. alphanumeric data).

In an embodiment, the method comprises a quality control reader to allow each item of printed data to be read, checked for readability and/or to be uploaded to a product tracing system. The method may comprise checking and/or uploading. The present invention allows an improved likelihood of all of the printed data being deemed readable by the quality controller even if a pause mode is entered.

In an embodiment of the second aspect, the apparatus comprises a quality control reader (e.g. camera) located downstream of the printer and the dryer, wherein the quality control reader is for reading the printing on the web, which is in the form of printed readable data, and optionally wherein the controller is configured to process the read printed data to check for readability and/or is configured to output the read data to a product tracing or tracking system.

In an embodiment of the first aspect, there is provided a driver for driving feeding of the web during the normal mode of operation, the method comprising, in the pause mode, pausing the driver after the printer is paused so that the web is fed forward by the driver by a sufficient distance to dry or cure the printing positioned between the printer and the dryer or curer. In an embodiment, the driver may comprise a target reel and a motor for rotating the target reel, wherein the target reel is paused from rotating or the motor is paused from rotating in the pause mode (after an initial delay from when the printer is paused).

In an embodiment of the first aspect, the method comprises, in the normal mode, feeding the web through a web storage part, thereby to maintain a substantially constant feed path length defined through the web storage part, wherein, in the pause mode, the web is fed from the web storage part in the machine direction, thereby changing, and preferably reducing, the length of the web feed path through the web storage part.

In an embodiment, the method comprises feeding the web in the machine direction during both the normal mode and the pause mode via a driver.

In an embodiment, the method comprises in the pause mode, pausing a driver (e.g. drive reel) while the printer is also paused, and while the driver is paused, feeding the web in the machine direction by with a driver (e.g. drive reel), thereby adjusting the length of the web feed path through the web storage part, the driver for feeding the web in the machine direction in the normal mode.

In an embodiment of the second aspect, the apparatus comprises a driver that is rotatable to feed the web in the machine direction, wherein the controller is configured to feed the web in the normal mode of operation using the driver thereby to maintain a constant feed path length defined through a web storage part, and wherein the controller is configured to pause the printer in the pause mode while feeding the web in the machine direction with the drive, thereby changing, and preferably reducing, the web feed path through the web storage path.

In an embodiment, the web storage part comprises a tension roller located between guide rollers that define, at least in part, the web feed path through the web storage part, wherein a position of the tension roller relative to the guide rollers is adjustable to adjust the length of the web feed path. The position of the tension roller may be adjustable by a movement of a tension arm. Alternatively, the position of the tension roller may be adjustable in other ways, e.g. by virtue of linear movement inside a slot.

The web storage part is not limited to the above configuration. It is sufficient that the web storage part provides a web feed buffer, permitting greater or lesser storage of web inside the web storage part by facilitating adjustment of a web feed path defined therethrough.

In one embodiment of the first and second aspects, the web storage part reacts to an increase in tension of the web during the pause mode, e.g. caused by the driver, thereby resulting in a reduced feed path length, whereas in the resume mode, the web storage part itself effects an increase in the feed path length. Alternatively, the converse may be realised.

In one embodiment of the first and second aspects, there is provided a web storage part defining a web feed path length therethrough, downstream and/or upstream driver and a lock. During normal mode, downstream driver causes the web to move in a machine feed direction, maintaining a substantially constant feed path length through the web storage part. During the pause mode, the driver, lock and web storage interact thereby to cause the web to move in the machine feed direction. During the resume mode, the driver, lock and web storage interact thereby to cause the web to move in the counter machine feed direction. Specifically, the web storage part can adjust the feed path length thereby to cause the web to move in one direction, whereas the driver and lock can activate either side of the web storage part thereby to cause the web to move in the other direction.

In an embodiment of the first and second aspects, the web storage part is located upstream of the printer and the dryer/curer. In this case, during pausing, the web is driven in the machine feed direction by a downstream driver, whilst the upstream web is held stationary, resulting in a reduction in the feed path length of the web storage part, and, during resuming, the web is caused to move in the counter machine feed direction by the action of the increase in feed path length of the web storage part, whilst the upstream web is held stationary. Alternatively, the web storage part may be located downstream of the printer and the dryer/curer. In this case, during pausing, the web is caused to move in the machine feed direction by the action of the increase in feed path length of the web storage part, whilst the downstream web is held stationary, and, during resuming, the web is moved counter to the machine direction by an upstream driver, resulting in a reduction in the feed path length of the web storage part, whilst the downstream web is held stationary. The machine direction is the direction that the web moves during feeding in the normal mode, and the counter machine direction is a direction of web movement during the resume mode that is opposite to the machine direction.

In an embodiment of the first aspect, the method comprises feeding the web through a web storage part in the normal mode, the web storage part defining an adjustable web feed path length therethrough, the method comprising, in the resume mode, moving the web counter to the machine direction by changing, and preferably increasing, the length of the web feed path in the web storage part. The web storage part used to move the web in the resume mode may be the same as the web storage part used to feed the web in the pause mode. In an embodiment, a driver operates to feed the web in the machine direction, while the driver is uncoupled in the resumed mode to allow the web to move in the counter machine direction by operation of the web storage part.

According to the above embodiment, the web can be moved in the counter machine direction without having to reverse operate a driver.

In an embodiment of the second aspect, the apparatus comprises a web storage part through which the web is fed in the normal mode of operation, the web storage part having an adjustable web feed path through the web storage part, and a reel that is rotatable by a driver to feed the web in the machine direction, the controller configured to feed the web in the machine direction by driving the driver to rotate the reel in the normal mode, and the controller is configured to free the reel and the driver so that the reel is able to reverse rotate in the resume mode while increasing the feed path through the web storage part to move the web counter to the machine direction.

In an embodiment of the first aspect, the method comprises in the normal mode, feeding the web from a source reel through the printer and dryer or curer and winding the web about a target reel. The method is thus a reel to reel method of printing on a web.

According to this embodiment, the method comprises providing blank web in the source reel for printing with, e.g., coded data, and feeding the blank web through the printer and the dryer to a target reel. As can be appreciated, it is highly desirable to have a complete target reel, comprising all of the web unwound from the source reel, without any unreadable printing and without any portions of the web missing printing.

In an embodiment of the second aspect, the apparatus comprises a source reel and a target reel and the controller is configured to unwind the web from the source reel and wind the web around the target reel in feeding the web in the machine direction during the normal mode of operation.

In an embodiment of the first aspect, the method comprises locking the source reel during the pause mode, while the printer is paused and while the web is fed in the machine direction and wound about the target reel.

In an embodiment of the second aspect, the controller is configured to lock the source reel during the pause mode, while the printer is paused and while the web is fed in the machine direction and wound about the target reel.

In an embodiment of the first aspect, the method comprises driving rotation of the target reel to feed the web in the machine direction during the normal mode.

In an embodiment of the second aspect, the apparatus comprises a driver (e.g. motor) for driving rotation of the target reel to feed the web in the machine direction to feed the web during the normal mode. In an embodiment, the controller is configured to lock rotation of the target reel in the pause mode and/or to lock the driver, after the driver has been operated at an initial time of the pause mode to wind web about the target reel so that the web is fed in the machine direction to feed the part of the web between the printer and the dryer or curer through the dryer or curer.

In an embodiment of the first aspect, the method comprises, in the resume mode, releasing the target reel for reverse rotation, as compared to forward rotation during feeding of the web in the machine direction in the normal mode, to allow the web to be fed counter to the machine direction. In an embodiment of the second aspect, the controller is configured to release the target reel for reverse rotation to allow the web to be fed counter to the machine direction during the resume mode. The target reel is released from the driver.

In an embodiment of the first and second aspects, the web is for forming labels, particularly for taxable products. The printer may be operated to print data including tax related information thereon. The labels are regularly sized and spaced in the machine direction and optionally also the cross-machine direction. The printer (which may comprise a plurality of printheads) is operable to print on one or more data items on each label.

The web may comprise an adhesive layer on one side and a print receiving side to allow the labels to be stuck on respective products with the printed information showing outwardly.

In an embodiment of the first and second aspects, the web is unwound from a source reel. The pause mode is operated by braking the source reel, pausing the printer while continuing to move the web in the machine direction and continuing to operate the dryer or curer at least until the printing on the web located between the printer and the dryer or curer upon pausing the printer is fed through the dryer or curer to dry or cure the printing. The web is allowed to be moved in the machine direction despite the braking of the source reel by releasing web stored in a web storage part. The web storage part may include a tension arm that moves from a start position in a direction away from applying tension to the web when the web is fed in the machine direction and the source reel has the brake applied. The web is moved forward during the pause mode by a driver.

In the pause mode, the web is fed forward in the machine direction a distance corresponding to at least a distance between the printer and the dryer or curer and preferably just this distance, and is thereafter paused. The web feeding may be paused by pausing the driver. In an embodiment, the pausing the driver may comprise braking a drive motor.

In an embodiment of the first and second aspects, the web is unwound from a source reel and wound about a target reel in a reel to reel operation for printing on the web. In an embodiment, the driver comprises a motor or other drive for rotating the target reel. In the pause mode, web feed may be paused by applying a brake to the target reel (e.g. through braking the drive).

In an embodiment of the first and second aspects, the resume mode includes operating the storage part to change, and preferably increase, the web that is stored therein, causing the web to move in the counter machine direction. This may be achieved by operating the tension arm. The tension arm may operate by releasing potential energy stored as a result of moving away from the start position during the pause mode, to thereby move back toward the start position to move the web counter to the machine direction or the tension may be driven toward the start position to move the web counter to the machine direction.

In an embodiment, the brake applied during the pause mode to the driver may be released to allow the web to move counter to the machine direction. In an embodiment, the brake applied to the target reel during the pause mode is released to allow the target reel to reverse rotate, e.g. free wheel in the reverse rotational direction relative to the drive motor or a drive transmission, so that the tension arm or web storage part can operate to move the web in the counter machine direction.

In an embodiment of the first and second aspects, the web is fed forward a predetermined distance in the pause mode while the printer is paused. The predetermined distance may be stored in memory. The memory may be accessible by the controller of the second aspect. In an embodiment, the distance corresponds to at least and preferably about the distance in the machine direction of the web between the printer and the dryer or curer. In an embodiment, the web is fed in the machine direction by the distance by measuring the web feed distance. The measuring may be implemented by a measuring wheel that rotates as the web is fed and by an amount proportional to the web feed distance, such as an encoder wheel in contact with the web.

In an embodiment of the first and second aspects, the predetermined distance for the pause mode is substantially the same as, or the same as minus an offset, the distance traversed during the counter feed movement in the resume mode. The measuring wheel may be employed during both modes to ensure the correct extent of movement during both operations is employed.

In the various aspects and embodiments, the printer may print ink in liquid form.

In the various aspects and embodiments, the web, or at least a layer receiving the printing, may be paper based.

In the various aspects and embodiment, the printer may print ultraviolet curable ink and the dryer or curer may be an ultraviolet curer.

DETAILED DESCRIPTION

To summarise features of the present invention, a printing operation is performed on a web at a printer. The web with printing thereon travels to a dryer or curer at which the printing is dried or cured. In a pause mode, movement of the web is to be paused. In order to avoid that the printing on the part of the web between the printer and the dryer or curer is spoiled while movement of the web is paused, the web is fed in the machine direction in the pause mode for a length of web from the printer to the dryer or curer while the printer is in a paused state and thereafter the web movement is paused.

In an embodiment, a portion of web that has not been printed on by the printer as a result of the paused state of the printer extends between the printer and the dryer or curer.

In an embodiment, in a resume mode for the transition from the pause mode back to a normal running mode, the web is moved back so that the portion of the web that not been printed on is positioned at or upstream of the printer. Subsequently, in the normal running mode, the web resumes moving forward, while the printer resumes the printing operation to print on the web. The printing is restarted so that the portion of the web that has not been printed on, and which portion was moved upstream of the printer in the resume mode, is subjected to the printing operation.

In an embodiment of the pause mode, the web is moved forward while the printing operation is paused by driving the web forward releasing stored web held in a tensioner.

In an embodiment of the resume mode, the web is moved backward by operating tensioner to store more web therein.

In an embodiment, blank web is unwound from a source reel and printed web is wound on a target reel. In the present application, the term 'blank web' does not necessarily mean that the web has no printing on it. This term instead refers to a web that has not yet been printed on at the printer.

In an embodiment, the printing comprises printing tax stamps or labels or printing on product packaging, labels or stamps. The printing can involve printing alphanumeric characters and/or printing codes.

The printing may include one or more security features, such as covert features. In particular, the printing ink may luminesce with a distinctive material signature.

Figure 1:
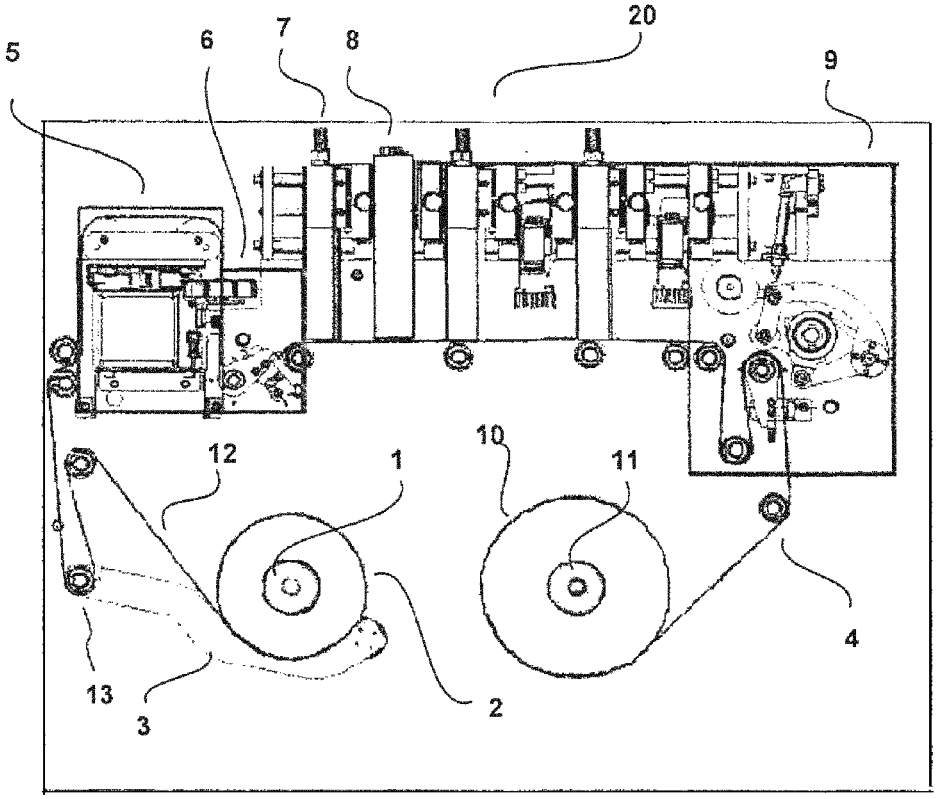
FIG. 1 shows a reel to reel printing apparatus according to an embodiment of the present invention.

Referring to FIG. 1, an unprinted web is unwound from a source reel, is passed through a printing unit and is wound on a target reel. The apparatus includes a web tensioning mechanism including guide rollers and a tension arm. Before passing through the printing unit, the web passes one or more sensors for sensing portions of the web to be printed on. This sensing is used to trigger the printing unit to print data on each portion. The apparatus also includes a quality control unit for reading data printed on the web by the printing unit. In FIG. 1, there is shown an apparatus 20 for printing codes on a web 12 of, e.g., product labels. The present embodiment is disclosed particularly with reference to printing codes for product labels or stamps, but the teachings of the present application are more generally applicable to printing information on a web of material.

The apparatus comprises a source chuck or reel 1 on which a blank stock web 2 is wound. The source chuck 1 serves to act as a source of web material 12 that is to be passed through the printing apparatus 20 so that codes or other information can be printed on the web 12. The source chuck 1 is rotatable to supply web 12 into the printing apparatus 20. A brake is associated with the source chuck 1 to apply tension to the web 12 unwinding from the source chuck 1.

The blank web 2 on the source reel 1 may be paper based web or other sheet-like flexible material that can be printed on. The blank web 2 is divisible into individual stamps or labels once printed on. For example, the web can be described as forming one or more labels or stamps in the cross machine direction and being divisible into separate labels or stamps at regular intervals in the machine direction. The blank web 2 may pre-include security features thereon associated with each label or stamp to be formed. For example, the security features may include watermarks, intaglio printing, etc.

The apparatus 20 also includes a printing unit 7 for printing codes on web 12 that has been unwound from the source chuck 1. The printing unit applies a code to each area of the web 12 for forming a stamp or label. The code facilitates the tracing of a product associated with the label or stamp throughout the supply chain from a manufacturing plant, and through a distribution hierarchy. The codes, when implemented on labels, stamps or packaging of duty excisable products, are able to be scanned helping government inspectors to ensure that taxes are properly paid.

The printing unit 7 may print the codes using security inks and may also print one or more further security features. For example, the printed codes may include covert security features that are identifiable by a special hand held device able to determine material properties of the ink.

The printing unit 7 includes a printer for printing the codes using ink that may be ultraviolet curable. The printing unit 7 may include more than one printer. The printing unit 7 may be a drop on demand printer such as an inkjet printer.

The printing unit 7 includes a curer or dryer, as discussed further below, spaced downstream from the printer of the printing unit 7. The downstream spacing prevents unwanted interference between the printer and the dryer or curer.

The apparatus 20 includes a target reel or chuck 11 on which the web 12 is wound into a winding of coded stamps or labels 10 (or material for forming product packaging) after having been printed with codes by the printing unit 7. The target reel 11 is associated with a driver that sets a machine direction speed of the web 12 passing through the apparatus 20 from the source reel 1 to the target reel 11. The driver may include a motor and a transmission.

The apparatus 20 includes a quality control unit 8 that is configured to read the printed information, e.g. product trace codes and/or tax codes. The quality control unit 8 is controlled to send the read information to a main application to track the information/codes printed and read as well as determine any errors or illegibility in the printed information.

In one implementation, the quality control unit 8 includes a camera for reading the printed information and a processor for interpreting the read information. The quality control unit 8 may also include a light source that is tailored to the ink or other material used for printing the information so that covert material based features associated with the ink can be read. For example, the ink may luminesce, e.g. fluoresce, in a way that is characteristic of the ink used and in a way that is determinable under certain lighting conditions. The quality control unit 7 may be configured to check a luminescence signature of the printed information as well as to allow checking and tracking of the information itself.

The apparatus 20 includes guide rollers 4 and a tension arm 3 having a tension roller 13 at an end of the tension arm 3. The tension arm applies a tensioning force on the web 12 by contact through the tension roller 13. The tension roller 13 contacts the web 12 at a location between (in the machine direction) the guide rollers 4. The tension arm 3 is operable to apply greater or lesser tension to the web 12. The tension arm 3 moves to allow web 12 to move forward during the pause mode of the apparatus 20 and moves in an opposite direction to reverse the web 12 during the resume mode, as is discussed further below.

The tension arm 3 is able to apply a constant tension to the web 12 by applying a force in the direction away from guide rollers 4 adjacent in the upstream and downstream direction. The tension on the web 12 applied by the tension arm 3 may be caused by a weight of the tension arm 3 acting through the web 12 and/or by pneumatic pressure acting to cause the tension arm 3 to apply tension to the web 12.

The web 12 includes markers associated with each portion of the web 12 that is to be printed on at the printing unit 7. In such an embodiment, the apparatus 20 includes one or more sensors 6 for detecting the markers. The markers can be dedicated contrast markings that are detectable by an appropriate sensor. Alternatively, the markers may be part of the web 12, such as perforation lines, or the markers may be a designated part of pre-printing on the web 12.

The markers are sensed by the one or more sensors 6, resulting in sensor producing a sense signal. The sense signal is used by a control system for timing printing on each portion of the web 12 by the printing unit 7. A plurality of sensors 6 can be provided in the apparatus 20 so that the printing apparatus 20 is operable with different types of webs 12, specifically those with dedicated contrast markers and those without such.

The apparatus 20 includes an alignment unit 5 to ensure the web 12 remains in the correct position in the cross-machine direction. This makes sure that the web is correctly positioned for downstream sensing with the one or more sensors 6, printing with the printing unit 7 and for quality control with the quality control unit 8.

The apparatus 20 further comprises an ejection unit 9 that allows printed parts on the web 12 that have been rejected by the quality control unit 8 to be ejected from the web 12 before being wound on the target reel 11. Further disclosure concerning an ejection unit 9 can be found from WO 2011/051396 A1.

Figure 2:
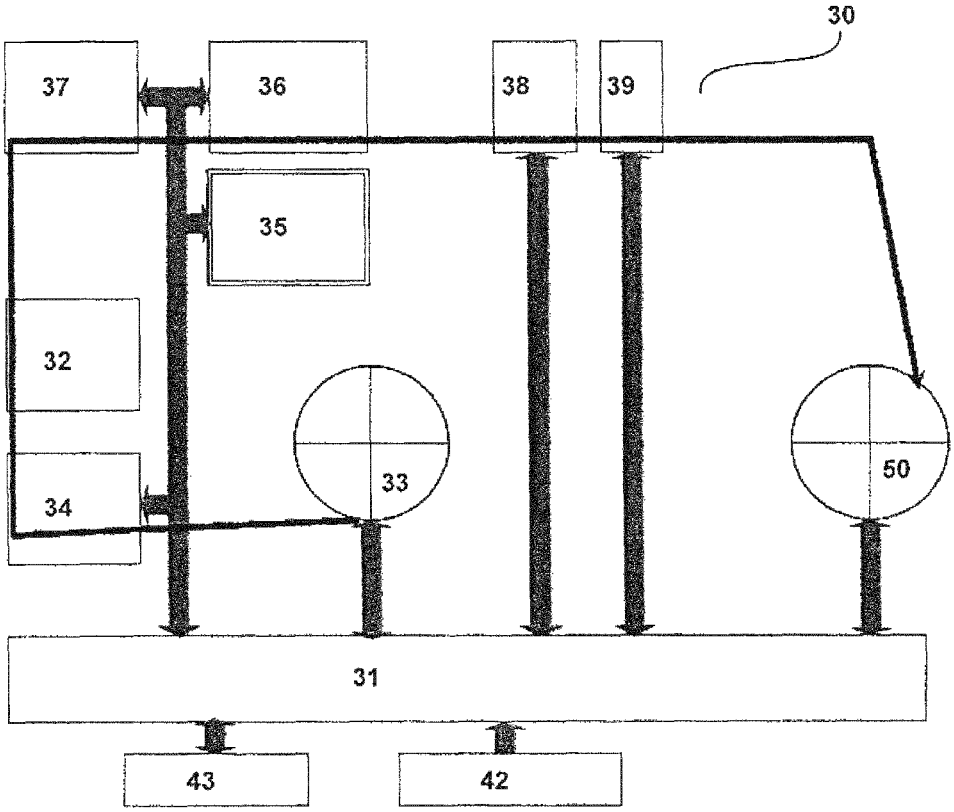
FIG. 2 shows a functional diagram of a control system of the present invention.

FIG. 2 shows a control system including an arm tension module for controlling web tension and also for implementing forward movement of the web during a pause mode and for implementing backward movement of the web during a resume mode. The control system includes a main controller that receives feedback from sensors to control web tension, web speed, timing of the printing unit and timing of the quality control unit. Further, FIG. 2 functionally illustrates a control system 30 used for controlling the apparatus 20 of the present invention. The control system 30 includes a controller 31 in communication with all modules in the control system 30 apart from the alignment module 32. The controller 31 is configured to receive output signals from the various modules, process the signals and output control command signals.

The controller 31 can be implemented using a processor and suitably programmed software. The controller 31 is configured to instruct various control modules to implement a normal running mode, a pause mode and a resume mode. These modes will be described in further detail below.

The control system 30 includes a brake reel control module 33 that is operable on a brake associated with the source reel 1. The strength of the brake is adjustable by the brake reel control module 33 in order to adjust tension on the web 12. The brake reel control module 33 is further operable to lock the source reel 1 from rotating, which is used in a paused mode of the apparatus 20 and control system 30 as will be described below. The controller 31 communicates with the brake reel control module 33 to set the strength of the brake acting on the source reel 1.

The control system 30 includes a tension module 34 that operates with a web tension sensor to determine tension on the web 12 as a sensed input for the controller 31. The web tension sensor may use compressed air to deflect the web 12 and to determine tension in the web 12 from the deflection. An output signal representative of web tension is sent to the controller 31. The controller uses this information and implements a feedback loop in communication with the brake reel module 33 to set the strength of the brake appropriately to ensure tension in the web 12 is as desired, e.g. within control limits.

The control system 30 includes an engine reel module 50. The engine reel module 50 operates in communication with a motor for driving the target reel 11. The engine reel module 50 is responsible, in association with the controller 31, for controlling speed of the web 12 through the printing apparatus 20.

The control system 30 includes a web speed module 37 that communicates with a web speed sensor in order to determine the machine directional speed of the web 12. The web speed sensor may be implemented by a wheel in contact with the web 12 and thus having a detectable rotational speed indicative of the speed of the web 12. The web speed module 37 is configured to determine the web speed from an output of the web speed sensor and to communicate the web speed with the controller 31.

The controller 31 is configured to receive an output signal from the web speed module 37 to implement a feedback loop in association with the engine reel module 50 to set the speed of the web 12 as desired, for example within control limits.

The control system 30 includes a printer module 38 that communicates with the printing unit 7 to print data on the web 12. In particular, the printer module 38 is effective to cause a printer of the printing unit 7 to print a code on each portion of the web 12. The codes may represent tracking data, such as product ID, production facility, date, time and optionally also tax data. The printer module 38 is responsive to a print signal from the controller 31 to instruct the printing unit 7 to print the data on the web 12.

The control system 30 includes at least one sensor module 35, 36 working with the one or more sensors 6 for determining a position of each portion of the web 12 to be printed on. For example, the sensor module may be operable to detect the position of each label or stamp sized, predetermined, portion of the web 12. The at least one sensor module 35, 36 is configured to output a signal indicating machine direction position of the web portion to the controller 31. Based on the position information, the controller times a print command signal to the printer module 38 to print data at the correct position on the web 12.

The at least one sensor module may include a contrast position module 35 working with a contrast sensor 6 for detecting a position of each predetermined portion in the web 12 by sensing contrast markings located at predetermined positions in each portion. Additionally or alternatively, the at least one sensor module may include an optical sensor module 36 that operates with an optical sensor 6 for determining optical characteristics located at a predetermined position of each portion of the web 12. In conjunction with an output from the at least one sensor module 35, 36 for determining a position of each portion in the web 12, the controller is able to command the printer module 38 to instruct the printing unit 7 to print data in each portion of the web 12 at the correct location.

The web portions described herein represent portions of the web 12 that are to be printed on. Generally, the web portions are of equal size and are positioned one after the other in a repeating sequence through the web 12. The web portions may correspond to individual labels, stamps or product packaging to be formed from the web 12.

The control system 30 includes a quality control module 39 that works with a camera of the quality control unit 8 to read data printed on the web 12 by the printing unit 7 and send this data to the controller 31 as an output. The quality control module 39 may be configured to operate a light source and optionally may include an optical filter to successfully read the printed data. The quality control module 39 works under instruction from the controller 31. The controller 31 is configured to trigger operation of the quality control module 39 to read the printed data at a time determined by the controller 31 that coincides with the printed data arriving at the quality control unit 8. The controller 31 is configured to determine the proper timing based on position information received from an output from the at least one sensor module 35, 36. The controller 31 is configured to send a signal representative of the printed data, as output from the quality control module 39, to a main application for product tracking and optionally also tax duty accounting purposes.

The control system 30 includes an alignment module 32 that operates with at least one sensor for detecting a cross-directional position of the web 12. The alignment module 32 operates autonomously. The alignment module 32 uses the sensed cross directional web position in determining an output signal for controlling a web position adjuster to correct cross-directional positioning of the web 12.

The control system 30 includes an interlock module 43 configured to ensure a door to the apparatus 20 is locked for personnel safety reasons. The interlock module 43 is configured to only allow the door to be unlocked when the source reel 1 and the target reel 11 are not rotating. The interlock module 43 is in communication with the controller 31 to output an interlock signal representative of the locked or unlocked state and to receive an output from the controller 31 representative of the moving status of the reels 1, 11.

The control system 30 includes an emergency stop module 42 that operates with an emergency stop button for the apparatus 20. The emergency stop module 42 is configured to communicate with the controller 31 when the emergency stop button has been activated to issue an output command for stopping the source reel 1 using the brake reel control module and/or for stopping the drive reel 11 using the engine reel control module 50.

In the normal running mode, the controller 31 is configured to instruct the engine reel module 40 to transport the web 12 at a predetermined speed based on a sensed speed of the web 12 from the web speed module 37. The target reel 11 is rotated under command from the engine reel control module 50 to transport the web 12 from the source reel 1 through guide rollers of the printing apparatus 20 to be wound on the target reel 11.

In the normal running mode, the controller 31 checks tension on the web 12 through the arm tension module 34 and instructs the brake reel module 33 appropriately to adjust the brake associated with the source reel 1 to adjust the web tension.

In the normal running mode, the controller 31 receives machine direction position information from the one or more sensor modules 35, 36 and triggers printing of data at each predetermined portion of the web 12 by issuing an appropriately timed trigger signal to the printer control module 38. In the normal running mode, the controller 31 also issues an appropriately timed signal to trigger the quality control module 39 to read the printed data at each portion of the web 12 based on the machine direction position information.

There are occasions in operation of the apparatus 20 when a pause mode is required when movement of the web 12 is to be paused. After the pause mode, according to the present invention, the apparatus enters a resume mode before the normal running mode is resumed. According to the present teachings, it is important that such a pause mode and such a resume mode does not cause wastage of the web 12 and/or spoiling of the printed data. The manner by which web wastage and printed data spoilage can occur is described below with reference to FIGS. 3 to 5 and the manner by which the present invention avoids such costly problems is described with reference to FIGS. 6 to 9.

Figure 3:
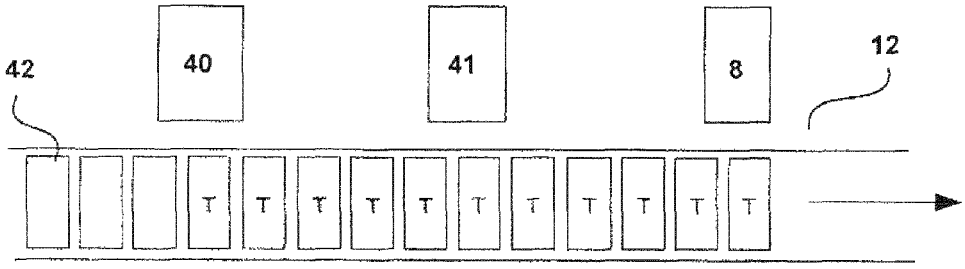
FIGS. 3 to 5 illustrate a web printing scheme that includes a pause mode introducing improperly printed data as a result of the pause mode.

Referring to FIG. 3, an interaction can be seen between the web 12, the printer 40 and the dryer or curer 41 of the printing unit 7 and the quality control unit 8. The web 12 is divided into predetermined portions 42 each representing an area of the web 12 for receiving printed data 'T' from the printer 40. The predetermined portions 42 may be real in the sense of the web having pre-printing thereon designating each portion 42 or they may be virtual portions 42, in which case contrast markers may be associated with each web portion 42. The predetermined portions 42 may form labels or stamps, particularly for items subject to tax duty.

Before the printer 40, the portions 42 are blank or unprinted in the sense of the data not yet having been printed on the web 12. In the uncured or undried portion of web 12, extending between the printer 40 and the dryer or curer 41, the data 'T' has been printed on the web 12 in each portion 42, but the printed data 'T' is not yet dried or cured.

After the dryer or curer 41, the printed data 'T' in each portion 42 is dried or cured. The quality control unit 8 is configured to read the dried or cured printed data 'T' to check readability as well as to output the read data for use in a tracking system and/or a tax duty accounting system.

Figure 4:
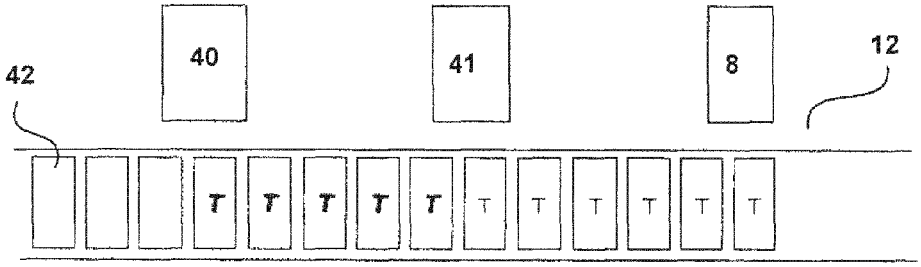

In a pause mode shown in FIG. 4, the web 12 is stopped and so does not move in the machine direction. In this paused mode, the printed data 'T' in the portion of the web extending between the printer 40 and the dryer 41 will not be cured or dried in sufficient time. This tends to spoil the printed data 'T' as a result of, for example, bleeding of the ink when liquid ink is used. Other types of ink or printing media will also lead to corrupted printing if not cured within an allotted time.

Accordingly, the printed data in each of the portions 42 of the web 12 in the stretch between the printer 40 and the dryer or curer 41 will likely not be readable by the quality control unit 8. The quality control unit 8 will flag these printed portions as rejected and they will have to be removed from the batch by way of the ejection unit, which is time consuming, difficult and costly in terms of materials (e.g. the web 12 and the print media).

Figure 5:
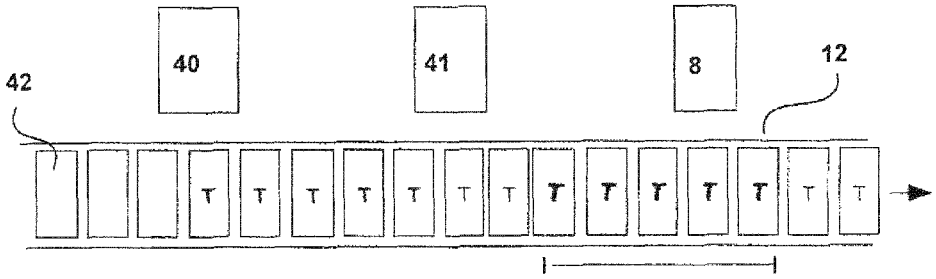

FIG. 5 shows the printed web 12 with movement of the web 12 resumed and with the apparatus 20 and the control system 30 in normal running mode. The printed web 12 has a length in the machine direction of five portions 44 with improperly cured or dried data thereon that are each rejected by the quality control unit 8.

In view of the above issues explained with reference to FIGS. 3 to 5, the system and method of the present invention implements pause and resume modes that can reduce or avoid any improperly cured or dried printed data and also reduce or avoid wastage of the web 12. These improvements are explained with reference to FIGS. 6 to 9.

Figure 6:
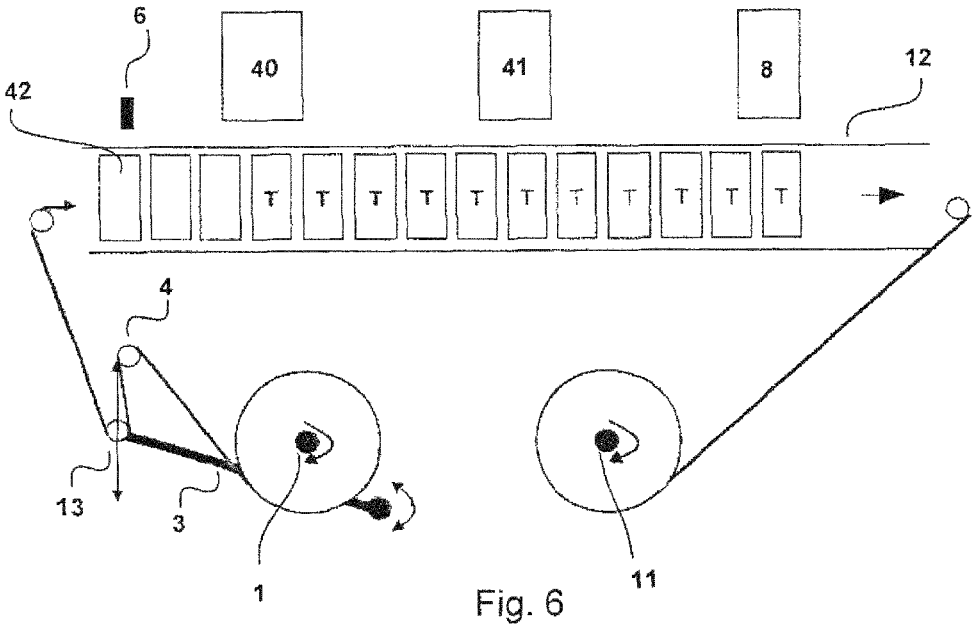
FIG. 6 shows printing on a web according to an embodiment of the present invention.

FIG. 6 shows a normal running mode in which the web is printed on at regular intervals by a printer. The printed web moves to a printing dryer or curer positioned downstream of the printer at which the printing is dried or cured. The printing on the dried or cured web is checked at a quality control unit. In particular, FIG. 6 shows a longitudinal segment of the web 12 travelling in the machine direction (as indicated by the arrow) in the normal running mode. It can be seen that the one or more sensors 6, the printer 40, the dryer or curer 41 and the quality control unit 8 are positioned in this order along the downstream direction. The normal running mode operates as described in detail above.

In particular, the web 12 is transported in the machine direction by driving the target reel 11. Tension is maintained on the web 12 through the brake associated with the source reel 1 and the tension arm 3. The one or more sensors 6 detect the location of each portion 42 (whether real or virtual as described above) for the purpose of triggering the printer 40 to print data at a correct location in each portion 42 and also for the purpose of triggering the quality control unit 8 to read the printed data 'T' in each portion 42.

In the region of the web 12 extending in the machine direction between the dryer or curer 41 and the printer 40, the printed data items 'T' are as yet uncured or undried as described above with respect to FIGS. 3 to 5. In the region of the web 12 downstream of the dryer or curer 41, the printed data 'T' on the web 12 is dried or cured. The quality control unit 8 is located downstream of the dryer or curer 41 for reading the printed data 'T'.

The interaction of the elements shown in FIG. 6 with the control system 30 of FIG. 2 has been described above.

Figure 7:
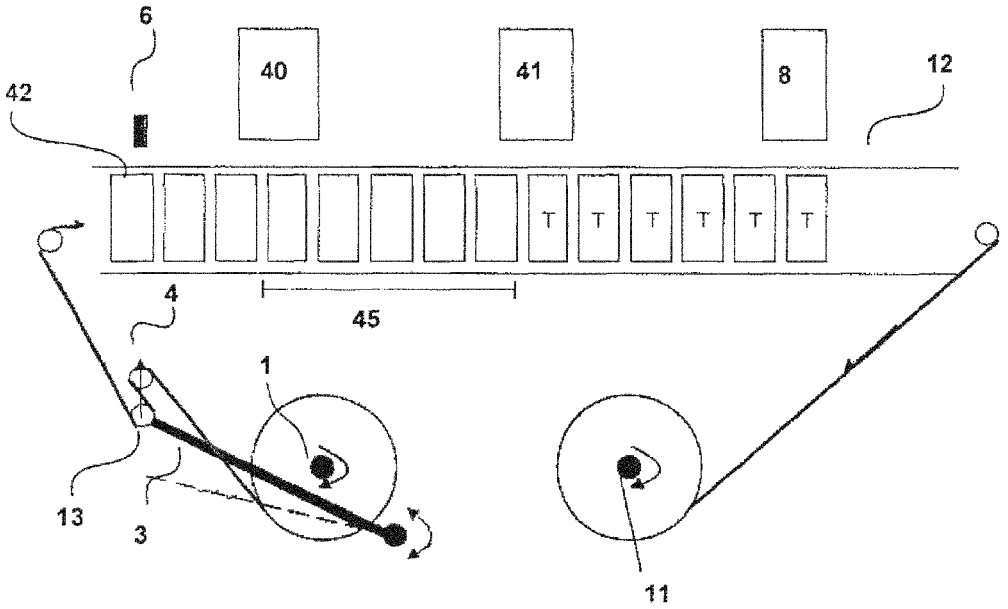
FIG. 7 shows a pause mode in which the printer is paused, but the web is allowed to continue running for a short distance after printing is paused.

As shown in FIG. 7, a short distance is just enough to pass through the dryer or curer all printing before print pause was entered. The short distance corresponds, generally, to the distance between the printer and the dryer or curer. After the short distance, web movement is also paused. The short amount of forward web movement in the pause mode is implemented by moving a tension arm to release web stored in the web feed path while a driver for driving feeding of the web is run for the short time and while a feed source of the web is paused. Referring to FIG. 7, a pause mode of the apparatus 20 and the control system 30 is explained. The controller 31 is configured to issue a pause command to relevant control modules. The source reel 1 is locked by the pause command from the controller 31 by operation of the brake through the brake reel module 33. At the same time as issuing a source reel 1 pause command to the brake reel module, a print pause command is sent to the printer module 38 to stop the printer 40 printing data on the web 12 at the next portion 42 and throughout the pause mode. The target reel 11 continues to be rotated to move the web 12 in the machine direction at the speed of the normal running mode with the source reel 1 locked and with the printer 40 stopped from printing data.

The controller 31 is configured to issue a drive pause command to the engine reel module 40 to stop rotation of the target reel 11 after a delay has elapsed from when the print pause command and the source reel pause command issued. More specifically, the controller 31 is in communication with a memory storing a distance that the web 12 has to be moved after the print pause command in order to move all of the printed portions 42 in the stretch between the printer 40 and the dryer or curer 41 through the dryer or curer. The distance stored in the memory corresponds to at least or about the length of the web 12 between the printer 40 and the dryer or curer 41. The controller may be in communication with an encoder wheel that rotates as the web 12 moves to measure the distance that the web 12 has been fed in the machine direction since the print pause command. The controller can compare the measured distance of movement of the web 12 to the distance stored in the memory to determine when to issue the drive pause command. The encoder wheel may be embodied by the above mentioned web speed wheel of the web speed sensor.

The web 12 is fed in the machine direction by a distance after the print pause command so that the printed data on each portion 42 extending between the printer 40 and dryer or curer 41 when the pause mode was initiated is moved at the normal running speed so as to be dried or cured by the dryer or curer 41. Once the last printed but not yet dried or cured item of data or portion 42 has passed through the dryer or curer 41, the drive pause command signal serves to stop rotation of the target reel 11 and the target reel 11 is also entered into a locked state. In a preferred embodiment, the target reel 11 is entered into a locked state by application of a target reel brake.

The distance between the printer 40 and the dryer or curer 41 is sufficient to ensure that the dryer or curer 41 does not cause drying or curing of ink in the printer 40. The distance may be 5 cm or greater, 10 cm or greater, 15 cm or greater or 20 cm or greater and may also be 50 cm or less, 40 cm or less or 30 cm or less. The distance may correspond to 5 portions 42 (data items) or more, 10 portions 42 or more or 15 portions 42 or more. The portions 42 may, for example, be 10 mm in length or greater and up to 150 mm in length, with one particular data item being printed per unit length.

The web 12 continues to run in the machine direction for about the distance between the printer 40 and the dryer or curer 41, even when the source reel 1 is rotationally locked. The web 12 is allowed to move by the tension arm 3 freeing web stored between adjacent (in the machine direction) guide rollers 4 and the tension roller 13. That is, the tension roller 13 moves against the bias of the tension arm toward adjacent guide rollers 4 to free sufficient web 12 to allow the web 12 to move the machine directional distance from the printer 40 to the dryer or curer 41.

Once the cause of the pause mode is removed (e.g. maintenance operation on camera of quality control unit 8 or on the printer 40 or on the dryer or curer 41 or some other maintenance operation requiring the apparatus 20 to be paused), the apparatus 20 and the control system 30 is to re-enter the normal running mode in order to print the remainder of the portions 42 with printed data 'T'. The pause mode shown in FIG. 7 has ensured that all printed data has been properly cured and dried and so has lead to the quality control unit accepting this printed data 'T' as normal and readable. However, there is a region 45 of unprinted or blank web 12 extending in the machine direction between the printer and the dryer or curer 41 that has not received printed data.

The preferred implementation of the present invention follows the pause mode with a resume mode bridging in time the pause mode and the normal running mode. In the resume mode, the web 12 is moved backwards so that the blank or unprinted region 45 is upstream of the printer 40. In this way, the normal mode of the apparatus 20 and the control system 30 can start and continue without any portions 42 in the winding 10 missing printed data.

Figure 8:
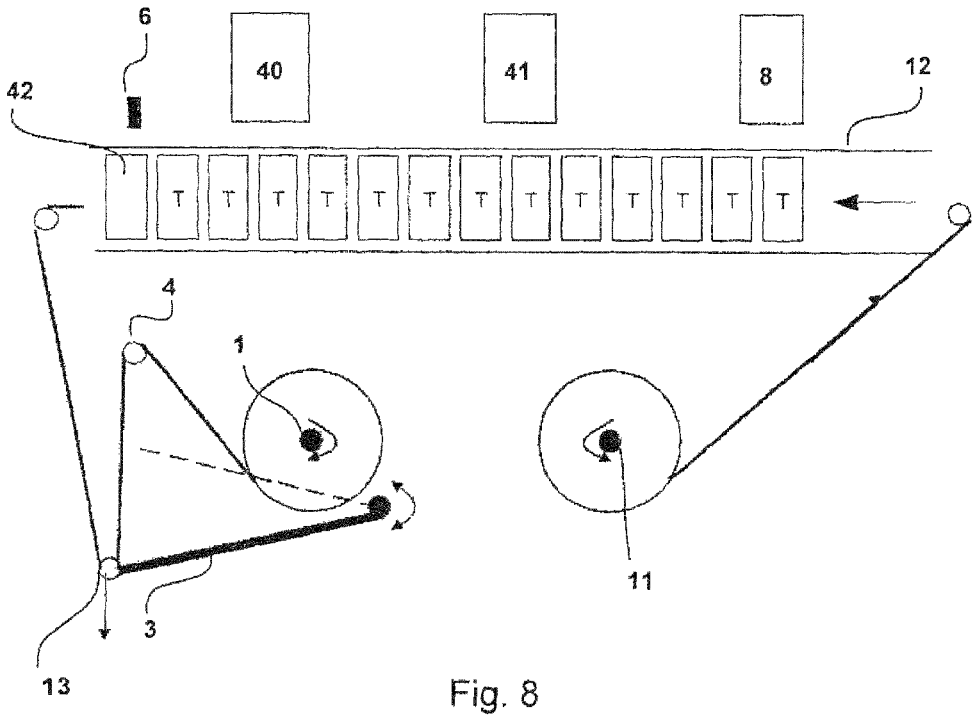
FIG. 8 shows web movement upon entry into a resume mode.

In the state depicted in FIG. 8, the web is moved backwards, by operation of the tension arm, to move the printed part of the web to a location upstream of the printer. In this way, printing can resume upon restart of forward running of the web without wasting any web as a result of stretches of unprinted web. A sensor is provided to allow detection of portions of the web representing locations of the web to be printed upon. The sensor is positioned upstream of the printer to assist timing of resumption of printing on the web. Referring to FIG. 8, the resume mode is explained in greater detail. In the resume mode, the controller 31 issues a resume mode command to the engine reel module 40 resulting in the target reel 11 being unlocked and in a free wheel state in the reverse direction. The tension arm 3 is biased away from the guide rollers 4 and thus biased to take up any slack by pulling the tension roller 13 away from the guide rollers 3. The bias may be through the weight of the tension arm 3 or hydraulic or other power assisted pressure. In the free wheel state of the target reel 11 and with the source reel 1 still rotationally locked, the tension arm 3 acts on the web 12 to pull the web 12 in the counter machine direction. The web 12 is caused to move to a location upstream (relative to the normal running mode machine direction) of the printer 40. The control system 30 and the apparatus 20 are now able to restart the normal running mode without missing any predetermined printing locations or portions 42, as explained in greater detail below. The pull back distance of the resume mode may be determined based on the feed distance that the tension arm 13 operates on the web 12 as a result of a change in potential energy caused by moving the weight upwards by a certain distance in the pause mode. Alternatively, the controller 31 may communicate with the above described encoder wheel to move the web 12 backwards by a target distance that can be measured by the encoder wheel. The controller 31 can communicate with the tension arm 13 to achieve the target distance.

Figure 9:
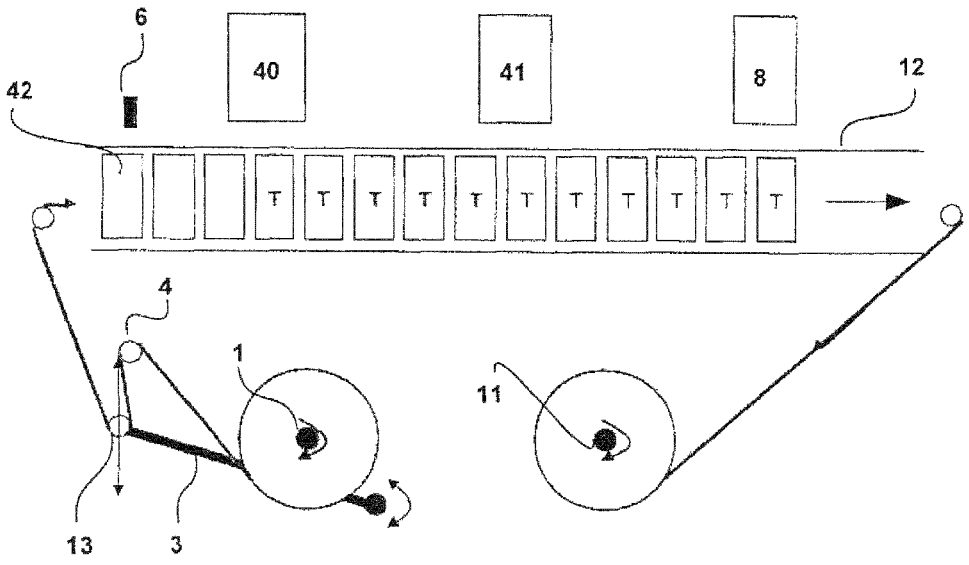
FIG. 9 shows a normal running mode after the resume mode in which the web is running forward, is printed on and dried or cured.

As shown in FIG. 9, resumption of the normal running mode has taken place without unprinted parts of the web occurring as a result of the backward movement step in the resume mode. The proper timing of restarting the printer is facilitated by the sensor, so that printing on the same web portion as has already been printed on in the previous normal mode is avoided and missing web portions from printing between successive normal modes is also avoided. Referring to FIG. 9, the apparatus 20 and control system 30 are shown in the normal running mode. More specifically, the controller 31 is configured to issue a restart command to the brake reel module 33 to release the lock on the source reel 1. The controller 31 is also configured to issue a restart command to the engine reel module 40, thereby the target reel 11 from the locked state, and to set the normal web speed, which is the same speed as before the pause mode was entered. The engine reel module 40 is configured to operate a motor for driving the target reel 11 at the set speed. The web is thus transported in the machine direction at the target speed.

The controller 31 is configured to implement the normal running mode as described above with reference to FIGS. 1 and 2. In particular, the one or more sensors 6 are configured to detect a machine directional position of each portion 42 and the associated sensor module 35, 36 reports that position information to the controller 31. The controller 31 is configured to time a print signal to the printer module 1 so that the first portion 42 is printed on, wherein the first portion is positioned adjacent upstream of the last printed portion 42 printed before the pause mode was entered. The controller also uses the position information to time the quality control module 39 as previously described.

In the normal running mode, with the web tension set at least in part by the brake applied to the source reel 1 (according to the previously described web tension feedback control), the tension arm 3 and the associated tension roller 13 moves back to its normal position, which is intermediate the position of the tension arm 3 during the paused mode and the position of the tension arm 3 during the resume mode. That is, a relatively large amount of web 12 is stored between the tension roller 13 and the guide rollers 4 during the resume mode, a relatively small amount of web 12 is stored during the pause mode and a relatively intermediate amount of web 12 is stored during the normal running mode.

As can be appreciated from FIG. 9, the pause and resume modes of the present embodiment allow each portion 42 of the web 12 to be successfully printed on and avoids printing twice on the same portion 42. In this way, a complete reel of printed web 10 can be obtained without blank portions 42 and without portions 42 printed with data rejected by the quality control unit 42, even when a pause mode is entered during printing.

Various alternatives could be provided to the above described embodiments, as would be conceived by the skilled person when provided with the present disclosure.

For example, the tension arm 13 may be power assisted. This means that the tension arm 13 can be biased against the web 12 with a lower force during the normal running mode and with a larger force during the resume mode. In this way, the full force required to reverse the web 12 is not applied during the normal running mode to protect from damaging or breaking lower strength webs.

During the resume mode, instead of being operated in a free wheel position, the target reel may be power assisted as the feed reel is counter fed under action of the web storage part. This could be useful in mitigating the effects of friction associated with free wheeling the target reel.

In an embodiment, there are multiple source reels and multiple target wheels that are running in parallel, and each could operate the present normal, pause and resume running modes.

In another embodiment, there are a plurality of webs running in parallel between the same source and target reels, which may also require a corresponding plurality of printers dryers or curers. Such an embodiment would also operate the presently disclosed normal, pause and resume modes.

In another embodiment, there is a web 12 that is sufficiently wide that a plurality of portions 42 are spaced in the cross machine direction of the web 12, perhaps printed by a corresponding plurality of printing units 7 spaced in the cross machine direction. In this way, a plurality of parallel portions 42 can be printed. That is, the web can divided into a grid of cross directionally spaced and machine directionally spaced portions 42, e.g. labels or stamps. Again, in this embodiment, a normal running mode would be operated in which the wider web is unwound from a source reel 1 and wound about a target reel 11, with intermediate printing and drying or curing steps. This embodiment would also operate pause and resume modes as described herein. Such modes would be especially important in view of the multiplied number of data portions 42 between the printer 40 and the dryer or curer 41 at any given time as a result of there being not just m data portions 42 in the machine direction, but also n data portions 42 in the cross machine direction, giving a total data portions 42 of n×m.

The invention claimed is:

1. A method of printing on a web, the method having at least a normal mode and a pause mode that are implemented at least in part by a controller and the method comprising:

in the normal mode:

feeding the web in a machine direction with a feeder;

printing on the web with a printer; and drying or curing the printing with a dryer or curer located, with respect to the machine direction, downstream of the printer; and in the pause mode:

pausing the printing on the web;

feeding, while the printing on the web is paused, the web in the machine direction by a distance such that a portion of the web located between the printer and the dryer or curer when the printing on the web is paused, is fed through the dryer or curer; and after the portion of web located between the printer and the dryer or curer when the printing on the web was pause has been fed through the dryer or curer, pausing feeding of the web in the machine direction.

2. The method of claim 1, wherein the portion of the web located between the printer and the dryer or curer when the printing on the web is paused has printing that has not yet been cured or dried, and when the portion of the web is fed through the dryer or curer, the printing on the portion is dried or cured.

3. The method of claim 1, wherein the feeding the web in the machine direction in the normal mode is carried out at a same speed or at a lower speed than in the pause mode.

4. The method of claim 1, wherein the web is to be partitioned into regular sized portions representing continuously repeating locations at which printing is to be applied and the method comprises printing with the printer on each regular sized portion as the web is fed in the machine direction in the normal mode.

5. The method of claim 4, wherein the method comprises printing discrete data items, such as codes, with one or more data items printed on each regular sized portion.

6. The method of claim 1, wherein the method further has a resume mode implemented at least in part by the controller to exit the pause mode and re-enter the normal mode, and the method further comprises, in the resume mode:

moving the web counter to the machine direction so that an unprinted portion of the web located between the printer and the dryer or curer after the feeding was paused in the pause mode is positioned, relative to the machine direction, upstream of the printer; and re-entering the normal mode so that the unprinted portion of the web is printed on with the printer and dried or cured by the dryer or curer as the web is fed in the machine direction.

7. The method of claim 6, wherein the method further comprises:

in the normal mode, printing on the web at regularly sized continuously repeating portions of the web, wherein, in preparing for re-entering the normal mode, the resume mode moves the web counter to the machine direction so that the first printed web portion upon re-entering into the normal mode is adjacent the last one of the regularly sized continuously repeating portions that was printed before the previous normal mode was exited.

8. The method of claim 1, wherein the method comprises detecting areas of the web with a position sensor located upstream of the printer and triggering printing on the web in the normal running mode based on the detected areas.

9. The method of claim 1, wherein the printing is in the form of readable printed data, and the method further comprises reading each item of readable printed data with a quality control reader, and wherein the readable printed data is able to be checked for readability and/or is able to be uploaded to a product tracing system.

10. The method of claim 1, further comprising:

in the normal mode, feeding the web through a web storage part defining an adjustable web feed path length to maintain a web feed path length that is fixed; and in the pause mode, feeding the web from the web storage part while reducing the length of the web feed path through the web storage part.

11. The method of claim 1, wherein the method comprises feeding the web in the machine direction during both the normal mode and the pause mode via a driver.

12. The method of claim 6, the method further comprising:

in the normal mode, feeding the web through a web storage part defining an adjustable web feed path length; and in the resume mode, moving the web counter to the machine direction while increasing the length of the web feed path length in the web storage part.

13. The method of claim 1, wherein the method further comprises, in the normal mode:

feeding the web from a source reel through the printer and the dryer or curer; and winding the web about a target reel.

14. An apparatus for printing on a web, the apparatus comprising:

a feeder for feeding the web in a machine direction;

a printer for printing on the web;

a dryer or curer located, with respect to the machine direction, downstream of the printer to dry or cure the printing on the web; and a controller configured to implement:

a normal mode of operation in which the web is fed in the machine direction, the web is printed on with the printer, and the printing is dried or cured with the dryer or curer; and a pause mode of operation in which printing of the web by the printer is paused while feeding of the web in the machine direction by the feeder continues so that a portion of the web located between the printer and the dryer at a start of the pause mode is fed through the dryer or curer to dry or cure the printing, whereupon the feeding of the web in the machine direction is paused.

15. The apparatus of claim 14, wherein the portion of the web located between the printer and the dryer or curer when the printing on the web is paused has printing that has not yet been cured or dried, and when the feeder feeds the portion of the web through the dryer or curer, the printing on the portion is dried or cured.

16. The apparatus of claim 14, wherein the controller is configured to feed the web in the machine direction in the normal mode at a same speed or at a lower speed than in the pause mode.

17. The apparatus of claim 14, wherein the web is to be partitioned into regular sized portions and the controller is configured to control the printer to print on the regular sized portions as the web is fed in the machine direction in the normal mode.

18. The apparatus of claim 14, wherein the controller is configured to control the printer to print discrete data items, such as codes, with one or more data items printed on each portion of the web.

19. The apparatus of claim 14, wherein the controller is further configured to:

implement a resume mode of operation, after exiting the pause mode and before re-entering the normal mode, in which the web is moved counter to the machine direction so that an unprinted portion of the web located between the printer and the dryer or curer after the pause mode is positioned, relative to the machine direction, upstream of the printer, and to subsequently re-enter the normal mode of operation in which the printer prints on the unprinted portion of the web and the dryer or curer dries the printing as the web is fed in the machine direction.

20. The apparatus of claim 19, wherein the control system is further configured to:

implement in the normal mode of operation printing at regularly sized continuously repeating portions of the web along the machine direction of the web, and to re-enter the normal mode after the pause mode by controlling the printer to commence printing on a one of the regularly sized continuously repeating portions that is located upstream of the regularly sized continuously repeating portion that was last printed on during the previously implemented normal mode in order to continue the sequence of printing on each regularly sized continuously repeating portion.

21. The apparatus of claim 14, further comprising a position sensor located upstream of the printer for detecting areas of the web that are regularly spaced in the machine direction throughout the web, and the control system is configured to implement the normal mode by triggering the printer to print on each portion of the web based on the detection of the areas by the position sensor.

22. The apparatus of claim 14, further comprising a quality control reader located downstream of the printer and the dryer, wherein the quality control reader is configured to read the printing on the web, which is in the form of printed readable data, wherein the controller is configured to process the read printed data to check for readability and/or is configured to output the read data to a product tracing or tracking system.

23. The apparatus of claim 14, further comprising a driver that is rotatable to feed the web in the machine direction and a web storage part that defines an adjustable web feed path, wherein controller is configured so that, in the normal mode, the web is fed through the web storage part using the driver, thereby maintaining a fixed web feed path, and so that, in the pause mode, the printer is paused and the web is fed out of the web storage part in the machine direction using the driver by at least a distance corresponding to a distance between the printer and the dryer or curer, which thereby reduces the web feed path length.

24. The apparatus of claim 19, further comprising:

a web storage part defining an adjustable web feed path in the normal mode, and a driver that is rotatable to feed the web in the machine direction and in the counter machine direction, wherein the controller is configured to feed the web, in the normal mode, in the machine direction by driving rotation of the driver, and the controller is configured to allow, in the resume mode, the driver to reverse rotation while increasing the feed path through the web storage part to move the web counter to the machine direction.

25. The apparatus of claim 14, further comprising:

a source reel; and a target reel, wherein the controller is configured to unwind the web from the source reel and to wind the web around the target reel in feeding the web in the machine direction during the normal mode of operation.

* * * * *